US006606020B1

(12) United States Patent
Kljucaricek

(10) Patent No.: US 6,606,020 B1
(45) Date of Patent: Aug. 12, 2003

(54) LOW COST METHOD OF MAKING A HIGH IMPEDANCE ELECTRICAL TRANSFORMER AND PRODUCTS OF SAID METHOD

(75) Inventor: Peter Kljucaricek, Shelby Township, MI (US)

(73) Assignee: William L. Fisher, Rochester, MI (US); part interest ( * ) Notice: Subject to any disclaimer, the term of this patent is extended or adjusted under 35 U.S.C. 154(b) by 0 days.

(21) Appl. No.: 10/094,903

(22) Filed: Mar. 12, 2002

(51) Int. Cl.[7] ..... H01F 27/28

(52) U.S. Cl. ..... 336/182; 336/160; 29/602.1; 29/605; 29/592.1; 29/606; 29/607

(58) Field of Search ..... 336/182, 160; 29/602.1, 605, 592.1, 606, 607

(56) References Cited

U.S. PATENT DOCUMENTS 3,693,127 A * 9/1972 Smith ..... 336/160

4,400,675 A * 8/1983 Thomas ..... 336/160

* cited by examiner

*Primary Examiner*—Lincoln Donovan
*Assistant Examiner*—Jennifer A Poker

(57) ABSTRACT

A low cost method of making a high impedance electrical transformer is disclosed as well as products of such method. The method comprises adding a step during the process of winding a transformer component which imparts higher impedance to the transformer employing such component by causing a portion of the total magnetic flux flowing therein to be shunted through a shunt of transformer steel. Such added step includes placing such shunt against a side of the primary coil and winding the secondary coil around both the shunt and the primary coil and also includes using the same coil form on which the primary coil was wound for winding the secondary coil. Such added step produces a high impedance transformer at a significant cost reduction over prior art methods of making a high impedance transformer.

8 Claims, 2 Drawing Sheets

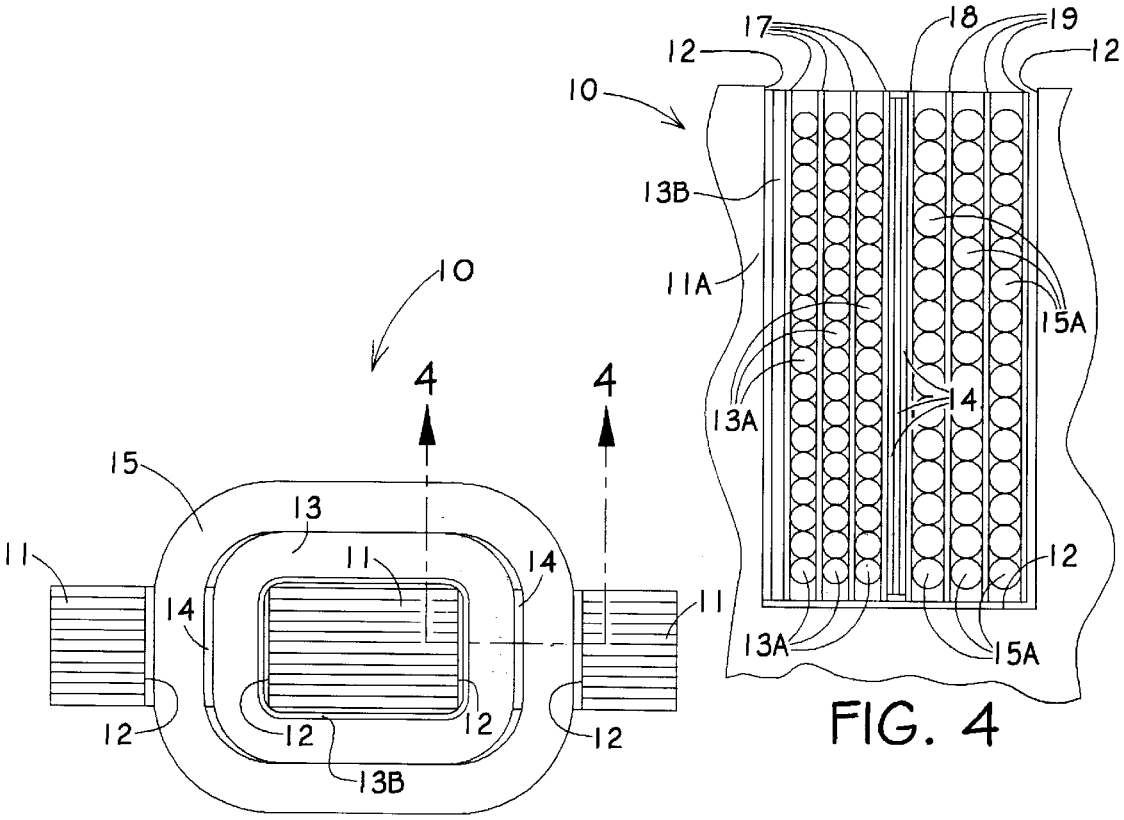
FIG. 3
FIG. 4
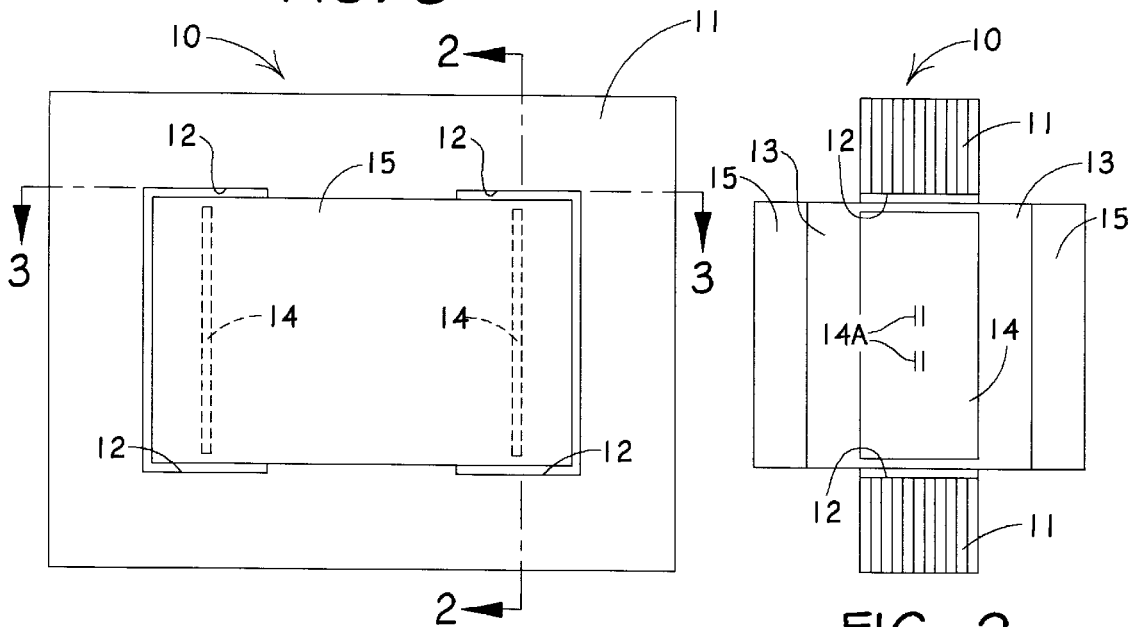
FIG. 1
FIG. 2

LOW COST METHOD OF MAKING A HIGH IMPEDANCE ELECTRICAL TRANSFORMER AND PRODUCTS OF SAID METHOD

My invention relates to high impedance electrical transformers.

The principal object of my invention is to provide a low cost method of making a high impedance electrical transformer.

BRIEF DESCRIPTION OF THE DRAWINGS

The foregoing object of my invention, and the advantages thereof, will become apparent during the course of the following description, taken in conjunction with the accompanying drawings, in which:

FIG. 1 is a front elevational view (with supporting hardware and terminals omitted) of a high impedance electrical transformer made in accordance with the method of my invention;

FIG. 2 is a vertical sectional view (with parts not cross-hatched) of the structure of FIG. 1, taken on the line 2—2 thereof;

FIG. 3 is a horizontal sectional view (with parts not cross-hatched) of the structure of FIG. 1 taken on the line 3—3 thereof;

FIG. 4 is a fragmentary vertical sectional view (with parts not cross-hatched) of the structure of FIG. 3 taken on the line 4—4 thereof which line 4—4 extends between two adjacent core laminates;

BACKGROUND OF THE INVENTION

Figure 8:
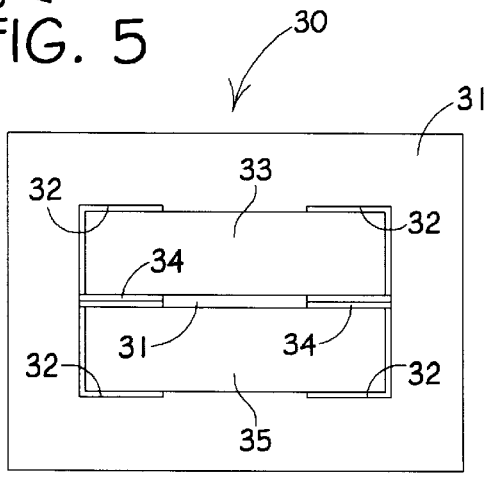
FIG. 8 PRIOR ART
FIG. 8 is a front elevational view (with supporting hardware and terminals omitted) of an example of a prior art high impedance transformer.

In the prior art, high impedance transformers are made by winding the primary and secondary coils on separate coil forms and by placing the coils, one above the other, as shown in FIG. 8 (which will be discussed in greater detail hereinafter).

DESCRIPTION OF A HIGH IMPEDANCE ELECTRICAL TRANSFORMER MADE USING THE METHOD OF MY INVENTION

Referring to the drawings in greater detail, and first to FIGS. 1–4, reference numeral 10 generally designates the transformer shown therein which is made according to the method of my invention. In the instance, the transformer 10 is a single phase transformer which comprises a core 11 made, as is well known in the art, of laminates stamped out of sheets of transformer steel. The core 11 has a pair of windows 12 therein. In FIGS. 2 and 3, the core 11 is not cross-hatched and coil wires and insulating material are omitted for clarity of illustration. The transformer 10 also includes primary and secondary coils 13 and 15, respectively. The added step of my invention includes placing a pair of shunts 14 cut from sheets or laminates of transformer steel against opposite sides of the primary coil 13 after completion of the winding thereof and prior to commencement of the winding the secondary coil 15. Transformer steel is insulated, as with varnish or an oxide coating; usually both sides thereof are insulated. As is well known, transformer steel is formulated as a special alloy to be an excellent conductor of magnetic flux while having high resistivity to current flow to minimize eddy current and hysteresis losses therein. Such special alloy steel is rolled in thicknesses of the order of that which I used (29 gauge; 0.014 inches thick) in making the cores for the two transformers (and for the pair of shunts for the one transformer) that I constructed as described hereinafter under the heading "A COMPARISON TEST".

In FIGS. 1 and 3 each shunt 14 is shown as a single laminate of transformer steel for clarity of illustration. However, each consists of three laminates of transformer steel, placed full face, one against the other, as shown for one of the pair of shunts 14 illustrated in FIG. 4. Laminates so placed full face, one against another form a stacked thickness for each shunt of the pair of shunts 14. Such stacked thicknesses for the pair of shunts 14 can vary from one to ten or even more laminates depending upon the impedance desired for the transformer 10.

The primary coil 13 is wound in the usual manner by winding wire layers around a coil form 13B (FIGS. 3 and 4). Three such wire layers 13A (FIG. 4) of the primary coil 13 are shown, in the instance. Insulating material is used on both sides of a wire layer, as shown in FIG. 4 and indicated at 17. An example of such insulating material is sold under the trademark "Nomex". Prior to winding of the secondary coil, the pair of shunts 14 are temporarily supported against such sides in any suitable manner, as by taping them thereto. Their exposed surfaces are insulated, as by covering them with suitable insulating material 18 (FIG. 4) comparable to insulating material 17. With the pair of shunts 14 and insulating material 18 (FIG. 4) in place against opposite sides of the primary coil 13, the secondary coil 15 is then wound in the usual manner employing, between its wire layers 15A (FIG. 4), insulating material 19 (FIG. 4) comparable to insulating material 17. In FIG. 4, the primary coil wires 13A, the coil form 13B, the single shunt 14 shown therein, the secondary coil wires 15A and the insulating material 17, 18 and 19 are not cross-hatched for clarity of illustration. Such added step of my invention includes using the same coil form 13B for winding the secondary coil as that which was used to wind the primary coil 13. Upon completion of the winding of the secondary coil 15, the pair of shunts 14 and insulating material 18 become permanently embedded between the outside of the primary coil 13 and the inside of the secondary coil 15. The principal component of the high impedance electrical transformer 10 made according to the method of my invention thus comprises the combination of the coil form 13B, the primary coil 13, the pair of shunts 14 and the secondary coil 15.

In the instance shown in FIGS. 1–4, the laminated core 11 has three legs, a pair of windows 12 therein and top and bottom yokes. The center leg is disposed within the coils 13 and 15 and the outer legs are disposed outside thereof. It is essential that the pair of shunts 14 be disposed within the pair of windows 12 and so that their widths extend along the thickness of the core 11 as best shown in FIG. 3. The widths of the pair of shunts 14 are usually equal to the thickness of the core 11. However, in some cases, the widths thereof may be greater or less than such core thickness. As previously mentioned, the core 11 is assembled in the usual manner using layers of mating "E" and "I" shaped laminates as is well known in the prior art. In FIG. 4, the fragmentary portion of the single laminate of the core 11 shown in elevation therein is designated 11A. The main magnetic flux flowing in the transformer 10 follows the path of the center leg of the core 11 and divides equally between the outer legs around the pair of windows 12 and closes itself back at the center leg. However, a portion of the total magnetic flux flows through the pair of shunts 14 as two separate flux paths which also close back at the center leg. This shunting of a portion of the total flux flow through the pair of shunts 14 during the alternating build up, collapse and change of direction of the magnetic field, adds inductive reactance to the windings and accounts for the higher impedance and greater current-limiting ability of the transformer 10. I believe that in the case of the transformer 10 some portion of the stray flux that is inherent therein may be captured by the pair of shunts 14 and caused to be shunted through them. If this be the case, it would be a benefit because such stray flux, as is so captured by the pair of shunts 14, would no longer be capable of causing eddy current losses in the windings. Shunts 14 made of grain-oriented transformer steel are preferred for use in my invention because they are better conductors of magnetic flux than non-grain oriented transformer steel. As is well known in the art, cold rolling of steel tends to orientate the crystalline structure or grains in the direction of rolling. Magnetic flux passes through a sheet of grain oriented transformer steel better in the direction of the grain thereof. FIG. 2 shows one of the pair of shunts 14 in elevation disposed against a side of the primary coil 13 (also shown in elevation); the insulating material 18 is omitted for purposes of clarity of illustration. The pair of shunts 14 are disposed so that the grain direction thereof, as indicated by the two sets of parallel lines 14A on the single shunt 14 (FIG. 2), is in the direction of the flow of magnetic flux through the transformer 10 as described above. The primary and secondary coils 13 and 15, respectively, are shown (FIGS. 2 and 4) of approximately equal height, which is usual. However, different heights for the two coils 13 and 15 may be required depending upon design considerations for that particular transformer.

DESCRIPTION OF ANOTHER HIGH IMPEDANCE ELECTRICAL TRANSFORMER MADE USING THE METHOD OF MY INVENTION

Figure 7:
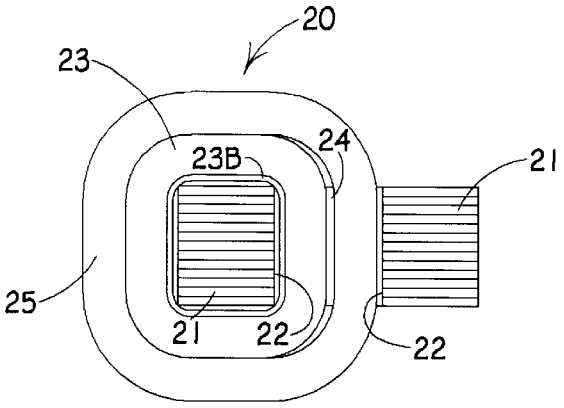
FIG. 7 is a horizontal sectional view (with parts not cross-hatched) of the structure of FIG. 5 taken on the line 7—7 thereof.
Figure 5:
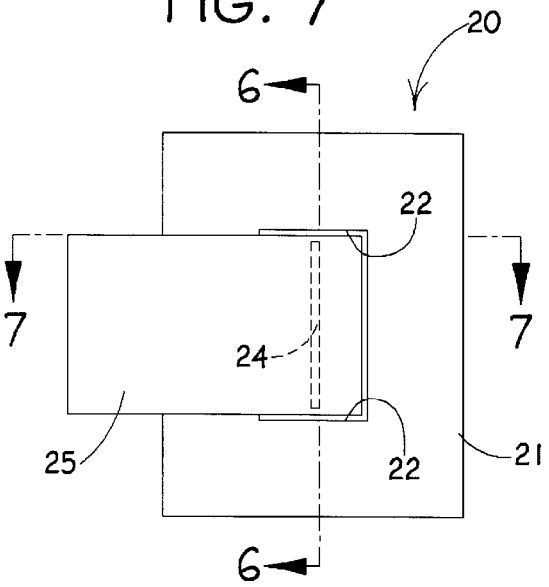
FIG. 5 is a front elevational view (with supporting hardware and terminals omitted) of another high impedance electrical transformer made in accordance with my invention.
Figure 6:
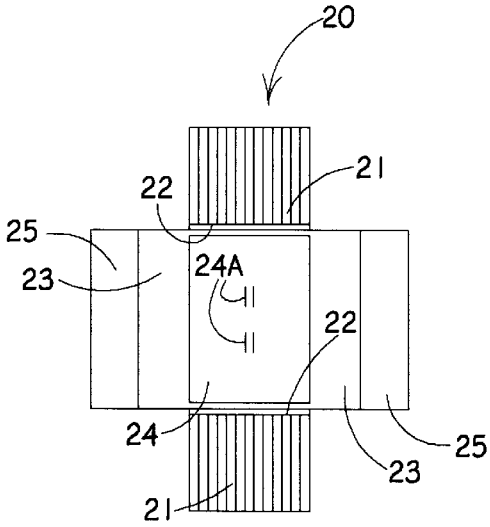
FIG. 6 is a vertical sectional view (with parts not cross-hatched) of the structure of FIG. 5 taken on the line 6—6 thereof.

Referring now to FIGS. 5–7, reference numeral 20 generally designates the transformer shown therein made according to the method of my invention. The transformer 20 is a single phase transformer which comprises a laminated core 21 of transformer steel having a window 22 therein, primary and secondary coils 23 and 25, respectively, and a shunt 24 of transformer steel placed against a side of the wound primary coil 23 in the added step of my invention prior to commencement of the winding of the secondary coil 25. In FIGS. 6 and 7, the core 21 is not cross-hatched and coil wires and insulating material are omitted for clarity of illustration. One leg of the core 21 is disposed within the coils 23 and 25 and the other leg outside thereof. The core 21 is assembled in the usual manner as described for the transformer 10 except that layers of mating "U" and "I" core laminates are used. The shunt 24 is shown as a single laminate of transformer steel for clarity of illustration, but may consist of more than one laminate placed full face, one against the other. The stacked thickness of laminates for the shunt 24 may vary depending upon the impedance desired for the transformer 20.

The primary coil 23 is wound in the usual manner by winding layers of wire around a coil form 23B (FIG. 7). The shunt 24 is temporarily supported against a side of the primary coil 23, as by taping it thereto. The exposed surface of the shunt 24 is covered by insulating material (not shown) comparable to insulating material 18. With the shunt 24 and insulating material in place against a side of the primary coil 23, the secondary coil 25 is then wound in the usual manner employing, between its wire layers insulating material (not shown) comparable to insulating material 19. Such added step includes winding the secondary coil 25 using the same coil form 23B on which the primary coil 23 was wound. Upon completion of the winding of the secondary coil 25, the shunt 24 and insulating material therefor (not shown) become permanently embedded between the outside of the primary coil 23 and the inside of the secondary coil 25. Like the pair of shunts 14, the shunt 24 is made of grain oriented transformer steel, the grain direction of which is shown in FIG. 6 and indicated by the two sets of parallel lines 24A. It is essential that the shunt 24 be disposed within the window 22 and so that its width extends along the thickness of the core 21 as best shown in FIG. 7. The width of the shunt 24 is usually equal to the thickness of the core 21. However, in some cases, the width thereof may be greater or less than such core thickness. The principal component of the high impedance transformer 20 made according to my invention comprises the coil form 23B, the primary coil 23, the shunt 24 and the secondary coil 25. Unlike the transformer 10, the transformer 20 has an unsymmetrical appearance; however their electrical characteristics are comparable to each other for the same size and KVA rating.

DESCRIPTION OF A PRIOR ART HIGH IMPEDANCE ELECTRICAL TRANSFORMER

Referring to FIG. 8, the prior art transformer shown therein, designated 30, is a high impedance electrical transformer comprising a laminated core 31 having a pair of windows 32 therein, a primary coil 33, a pair of shunts 34 and a secondary coil 35. The shunts 34 are disposed within the windows 32, respectively. Each shunt 34 is shown as consisting of two "I" shaped laminates of transformer steel placed between the top of the secondary coil 35 and the bottom of the primary coil 33, but can consist of more than two such laminates, placed one on top of another. The stacked height of the shunts 34 may vary depending upon the impedance desired for the transformer 30. Their lengths (not shown) is usually equal to the thickness of the core 31. The transformer 30 is more costly to build than the either the transformer 10 or the transformer 20 because the coils 33 and 35 have to be separately wound (each requiring its own coil form).

A COMPARISON TEST

To prove the utility of my invention, I made a single phase, 60 Hz high impedance transformer of the type shown in FIG. 1. The transformer had a rating of 3 KVA, 480 primary volts, 120 secondary volts and secondary current of 25 amperes. I used for each of the pair of shunts 14, three rectangular sheets of grain oriented transformer steel, each having dimensions of 4 inches wide by 2.75 inches high by 29 gauge (0.014 inches) thick. The core was made using standard size laminates (size "EI 212", in the instance) stacked up to 4 inches thickness.

I prefer that high impedance transformers and components therefor made according to the method of my invention be referred to by the trade-mark "HIT". For comparison purposes, I also made a single phase, 60 Hz standard transformer of low impedance by omitting the pair of shunts 14, but otherwise having identical construction, size, KVA rating, voltage and current.

I then determined the impedance of each transformer in the following way: I short circuited the secondary and then, using a variable transformer, I energized the primary gradually from zero until its nominal primary current of 6.25 amperes was reached. In the case of the standard low impedance transformer, the nominal primary current was reached with the application of 18.5 volts. With my HIT transformer, the nominal primary current was reached with the application of 36.8 volts. The higher applied voltage required for my HIT transformer to achieve nominal primary current of 6.25 amperes is due, of course, to the higher impedance thereof caused by a portion of the total magnetic flux flowing in the transformer being by-passed by flowing through the pair of shunts 14.

The impedance of the standard low impedance transformer was calculated by determining the ratio of the applied voltage of 18.5 volts to the rated primary voltage of 480 volts multiplied by 100 which equals 3.8% impedance. The impedance of my HIT transformer was also calculated by determining the ratio of the applied voltage of 36.8 volts to the rated primary voltage of 480 volts multiplied by 100 which equals 7.7% impedance.

With the impedance value of each transformer being known, the short circuit secondary current can be calculated using the following formula: short circuit secondary current equals nominal primary current (of 6.25 amperes) multiplied by 100 divided by % impedance. This results in 81.2 amperes for my HIT transformer, while that for the standard low impedance transformer is 164.5 amperes. These calculated results (of 81.2 amperes and 164.5 amperes) are the highest secondary current values that can occur when full primary voltage of 480 volts is applied. Yet for my HIT transformer, the value of 81.2 amperes is just a little more than three times its nominal secondary current of 25 amperes. This brings out the current-limiting ability of my HIT transformer under dead short conditions (full primary voltage and shorted secondary).

Using embedded thermocouples, I measured the temperature rise during operation of each transformer for a three hour test period and found them to be equal to each other within a few degrees centigrade.

This shows that the influence upon temperature rise from the presence of the pair of shunts 14 was negligible. Using selected charts, I calculated the heat loss of the pair of shunts 14 while saturated and determined same to be about one watt each, at most. The two experimental transformers that I made had a rating of 3 KVA, but my invention is useful for smaller (as low as 1/10th KVA) and larger (100 KVA or more) ratings. In the case of larger KVA transformers the cores thereof are usually assembled using only "I" shaped laminates of the same width, but of different lengths.

With my low cost method of making high impedance transformers, they should be more readily available for use in circuitry where they are most valuable such as in control circuits using semiconductor devices such as thyristors. Further cost savings can be realized because thyristors and their protection devices (fuses and circuit breakers) of lower current ratings can be employed when using my HIT transformers. Because the cost of making my HIT transformers is so low as to be nearly equal to that for standard control transformers (low impedance), their usage should increase rapidly. In such event, they could be stocked at electrical supply houses and would not have to be special ordered from the factory.

The component for transformer 10 consisting of the coil form 13B, the primary coil 13, the pair of shunts 14 and the secondary coil 15 can also be employed in building high impedance transformers for multi-phase systems (for example, two or three phases). The same applies to the component for transformer 20 consisting of the coil form 23B, the primary coil 23, the shunt 24 and the secondary coil 25. Likewise, transformers having more windings than just primary and secondary coils can be made according to the method of my invention. This would be accomplished by placing the pair of shunts 14 or shunt 24, as the case may be, against a side or sides of the first coil after completion of its winding and prior to winding additional coils. Thereafter, the second coil would be wound around both the primary coil and the pair of shunts 14 or the shunt 24 as the case may be. The same coil form used to wind the primary coil would be used for winding each additional coil.

SUMMARY

The low cost method of making a high impedance electrical transformer according to my invention comprises adding a step during the process of winding a transformer component which imparts higher impedance to the transformer employing such component by causing a portion of the total magnetic flux flowing therein to be shunted through a shunt of transformer steel. Such added step includes placing such shunt against a side of the primary coil after its winding is complete and before commencing to wind the secondary coil and thereafter completing the winding of the secondary coil around both the shunt and the primary coil. Such step also includes winding the secondary coil using the same coil form on which the primary coil was wound, whereby to produce a high impedance electrical transformer at a significant cost reduction over prior art methods of making a high impedance transformer.

It is to be understood that variations and changes can be resorted to without departing from the spirit of my invention as defined by the appended claims.

What is claim is:

1. A low cost method of making a high impedance electrical transformer comprising adding a step during the process of winding a transformer component which imparts higher impedance to the transformer employing such component by causing a portion of the total magnetic flux flowing therein to be shunted through a shunt of transformer steel, said added step includes placing such shunt against a side of the primary coil and winding the secondary coil around both the shunt and the primary coil and also includes winding the secondary coil using the same coil form on which the primary coil was wound.

2. A transformer component for a high impedance electrical transformer made according to the method of claim 1.

3. A low cost method of making a high impedance electrical transformer comprising winding a transformer component in accordance with the method of claim 1 and further comprising forming a core therefor which has a window therein and arranging the core in respect to the shunt so that the latter is disposed within said window with its width extending along the thickness of the core.

4. A high impedance electrical transformer made according to the method of claim 3.

5. A low cost method of making a high impedance electrical transformer comprising adding a step during the process of winding a transformer component which imparts higher impedance to the transformer employing such component by causing a portion of the total magnetic flux flowing therein to be shunted through shunts of transformer steel, said added step including placing a pair of such shunts against opposite sides of the primary coil and winding the secondary coil around both the pair of shunts and the primary coil and also includes winding the secondary coil using the same coil form on which the primary coil was wound.

6. A transformer component for a high impedance electrical transformer made according to the method of claim 5.

7. Improvement in the method of making a high impedance electrical transformer comprising winding a transformer component in accordance with the method of claim 5 and further comprising forming a core therefor which has a pair of windows therein and arranging the core in respect the pair of shunts so that they are disposed within the pair of windows, respectively, with their widths extending along the thickness of the core.

8. A high impedance electrical transformer made according to the method of claim 7.

* * * * *